United States Patent [19]

Muto et al.

[11] Patent Number: 5,059,503

[45] Date of Patent: Oct. 22, 1991

[54] ELECTROPHOTOSENSITIVE MATERIAL WITH COMBINATION OF CHARGE TRANSFER MATERIALS

[75] Inventors: Nariaki Muto, Daito; Tatsuo Maeda, Kobe; Toshihiko Nishiguchi, Moriguchi; Mikio Kakui, Mino; Keisuke Sumida, Hirakata; Toru Nakazawa, Osaka, all of Japan

[73] Assignee: Mita Industrial Co., Ltd., Osaka, Japan

[21] Appl. No.: 501,040

[22] Filed: Mar. 29, 1990

[30] Foreign Application Priority Data

| | | | |
|---|---|---|---|
| Mar. 30, 1989 | [JP] | Japan | 1-80012 |
| Mar. 30, 1989 | [JP] | Japan | 1-80013 |
| Mar. 30, 1989 | [JP] | Japan | 1-80014 |
| Mar. 30, 1989 | [JP] | Japan | 1-80015 |
| Mar. 30, 1989 | [JP] | Japan | 1-80016 |
| Mar. 30, 1989 | [JP] | Japan | 1-80017 |
| Mar. 30, 1989 | [JP] | Japan | 1-80018 |

[51] Int. Cl.[5] ..... G03G 5/09

[52] U.S. Cl. ..... 430/83; 430/59

[58] Field of Search ..... 430/59, 83

[56] References Cited

U.S. PATENT DOCUMENTS

| | | | |
|---|---|---|---|
| 3,314,788 | 4/1967 | Mattor | 430/74 |
| 3,615,404 | 10/1971 | Price et al. | 430/83 X |
| 4,078,925 | 3/1978 | Horgan | 430/59 |
| 4,273,846 | 6/1981 | Pai et al. | 430/59 |
| 4,365,014 | 12/1982 | Sakai et al. | 430/59 |
| 4,743,521 | 5/1988 | Hoffmann et al. | 430/59 X |

FOREIGN PATENT DOCUMENTS

| | | | |
|---|---|---|---|
| 37356 | 2/1990 | Japan | 430/59 |

*Primary Examiner*—Roland Martin

*Attorney, Agent, or Firm*—Beveridge, DeGrandi & Weilacher

[57] ABSTRACT

The present invention provides an electrophotosensitive material containing the diamine derivative represented by the following general formula (I) and at least one selected from the group consisting of the hydrazone compound, fluorene compound and m-phenylenediamine compound.

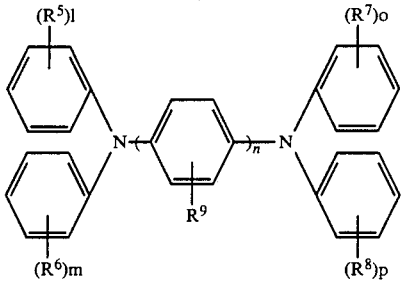

(I)

wherein $R^5$ to $R^9$, l, m, n, o and p are as defined.

24 Claims, No Drawings

ELECTROPHOTOSENSITIVE MATERIAL WITH COMBINATION OF CHARGE TRANSFER MATERIALS

BACKGROUND OF THE INVENTION

The present invention relates to an electrophotosensitive material. More particularly the invention relates to the electrophotosensitive materials ideally utilized for the image forming apparatus such as copying machine.

Recently, an organic photosensitive materials are utilized for the electrophotosensitive material because the organic layer have wide freedom for the functional designing as well as workability and advantageous in production costs. It is well known that as the organic photosensitive material, the high sensitive functional types electrophotosensitive material provides a photosensitive layer wherein the electric charge generating with exposure to light function with a charge-generating material and the electric charge-transferring function with a charge-transferring material which materials are separated type.

There are variety of function-separated type photosensitive material such as multilayer type which comprises a charge-generating layer at least containing a charge-generating material, and a charge-transferring layer at least containing a charge-transferring material and a binding resin; and single layer type photosensitive material wherein both of a charge-generating material and a charge-transferring material are dispersed into a binding resin.

The multilayer type photosensitive material is different from the single layer type, have an advantage in providing a high sensitivity and wide availability for selecting photosensitive material because the functions thereof are separated into two.

For reasons that major charge-transferring materials are positive charge, and that durability is given to the surface, the structure of multilayer type photosensitive material for negative electrification wherein the charge-generating layer is provided on the conductive substrate, and the charge-transferring layer is provided thereon, is generally employed. However, the multilayer type photosensitive material for negative electrification may generate ozone into the ambient atmosphere on negative electrifying, causing the sensitive layer to deteriorate and copying environment to contaminate, and the positive charge toner, which is difficult to make, is necessary in developing process.

On the other side, the above mentioned single-layer type electrophotosensitive material can be charged negatively. Accordingly, the single-layer type electrophotosensitive material can be used with negative charge toner which is easy to manufacture. The negative charge toner may be produced with various materials. However, both of electron and positive hole are moved in one layer wherein either electron or positive hole are trapped, causing the residual potential increasing. Moreover, it is yet a problem that electrophotosensitive characteristics such as the electrification characteristics. sensitivity and residual potential much depend upon the combination of charge-generating material and charge-transferring material.

In order to remove the above mentioned problems, the electrophotosensitive material in which diamine derivatives are used as charge-transferring material, is proposed. The diamine derivatives are not only having symmetrical molecular structure, taking no part in isomerization reaction caused by light irradiation and providing light stability but features showing large drift mobility and low electric field strength dependency.

The electrophotosensitive material using diamine derivatives as charge-transferring material have high sensitivity and low residual potential.

However, these electrophotosensitive material are not yet complete to obtain the sufficient sensitivity and stability of surface potential in repetition of copying process.

SUMMARY OF THE INVENTION

It is an object of the present invention to provide a electrophotosensitive material which is superior in the electrophotosensitive characteristics such as electrification characteristics, sensitivity, residual potential and stability for reproducing.

According to the present invention, there is provided the electrophotosensitive materials having the photosensitive layer containing diamine derivatives represented by the following general formula (I) as charge transferring material and at least one selected from the group consisting of hydrazone compounds represented by the following general formula (II), fluorene compounds represented by the following general formula (III) and m-phenylenediamine compounds represented by the following general formula (IV).

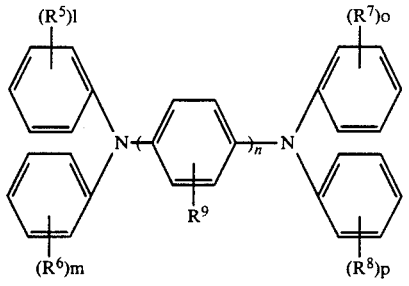

(I)

wherein $R^5$, $R^6$, $R^7$, $R^8$ and $R^9$ are the same or different, hydrogen atom, lower alkyl group, lower alkoxy group or halogen atom, n is an integer from 1 to 3.

l, m, o and p are the same or different, integers from 0 to 2, and at least one group selected from the following groups:

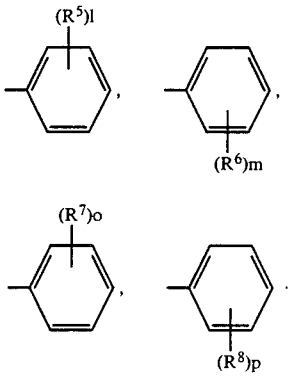

may form a condensed ring with benzene ring which may have a lower alkyl group, lower alkoxy group or halogen atom as a substituent.

(II)

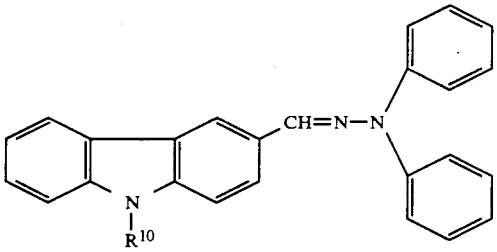

wherein $R^{10}$ is a hydrogen atom or alkyl group.

(III)

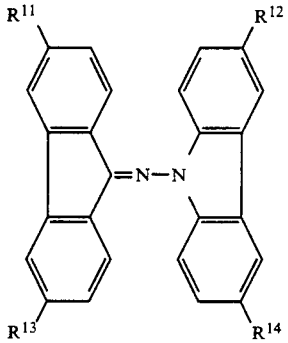

wherein $R^{11}$, $R^{12}$, $R^{13}$ and $R^{14}$ are the same or different, hydrogen atom or alkyl group.

(IV)

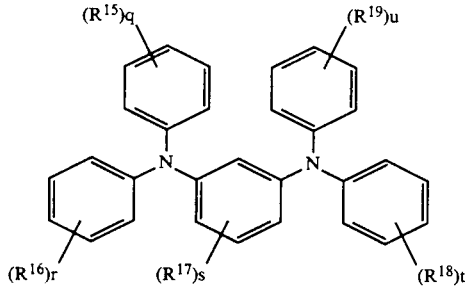

wherein $R^{15}$, $R^{16}$, $R^{17}$, $R^{18}$ and $R^{19}$ are the same or different, hydrogen atom, alkyl group, alkoxy group or halogen atom, q, r, t and u are the same or different, integers from 0 to 5, s is an integer form 0 to 4.

It has been found by the inventors who applied themselves closely to the research that the photosensitive material containing diamine derivatives as charge-transferring material represented by the general formula (I), can maintain stable surface potential in repetation of copying process by adding at least one compound selected from the group consisting of hydrazone compounds represented by the general formula (II), fluorene compounds represented by the general formula (III) and m-phenylenediamine compounds represented by the general formula (IV).

DETAILED DESCRIPTION OF THE INVENTION

The diamine derivatives used as charge-transferring material are represented by the general formula (I) mentioned above.

Examples of the diamine derivatives represented by the general formula (I) include the compounds represented by the following general formulas (Ia), (Ib), (Ic) and (Id).

(Ia)

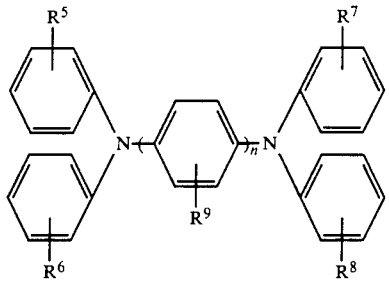

(Ib)

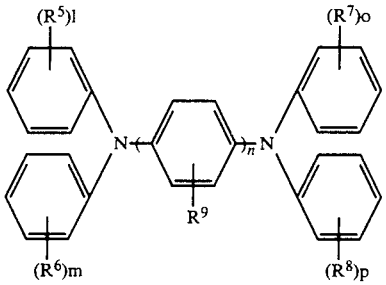

(Ic)

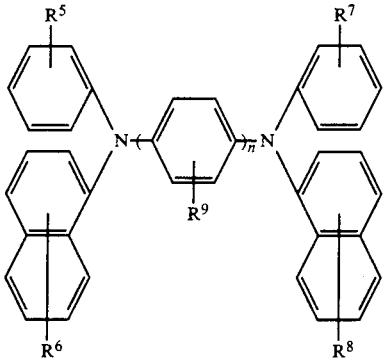

(Id)

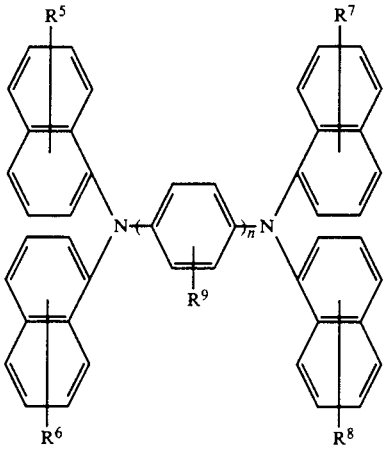

wherein $R^5$, $R^6$, $R^7$, $R^8$ and $R^9$ are the same or different, hydrogen atom, lower alkyl group, lower alkoxy group or halogen atom, n is an integer from 1 to 3, l,m,o and p are the same or different integers from 0 to 2. However, in the general formula (Ib). $R^5$, $R^6$, $R^7$ and $R^8$ are not simultaneously hydrogen atom, and at least one of the l, m, o and p is 2, when corresponding $R^5$, $R^6$, $R^7$ and $R^8$ are not hydrogen atom.

In aforementioned diamine derivatives represented by the general formulas (I) and (Ia) to (Id), examples of the lower alkyl group include alkyl groups having 1 to 6 carbon atoms such as methyl, ethyl, propyl, isopropyl, butyl, isobutyl, tert-butyl, pentyl and hexyl, preferably alkyl groups having 1 to 4 carbon atoms. Examples of lower alkoxy group include alkoxy groups having 1 to 6 carbon atoms such as methoxy, ethoxy, propoxy, butoxy, isobutoxy, tert-butoxy, pentyloxy and hexyloxy, preferably alkoxy groups having 1 to 4 carbon atoms. Examples of the halogen atom are fluorine atom, chlorine atom, bromine atom and iodorine atom.

The aforementioned substituents $R^5$ to $R^9$ may be substituted on any position of phenyl or naphthyl ring.

In the diamine derivatives represented by the general formula (Ia), examples of preferable compound included in p-phenylenediamine derivatives of n=1, are 1,4-bis(N,N-diphenylamino)benzene,
1-(N,N-diphenylamino)-4-[N-(3-methylphenyl)N-phenylamino]benzene,
1,4-bis[N-(3-methylphenyl)-N-phenylamino]benzene and the like, and other diamine derivatives are exemplified in Page 4 line 9 of left lower column to Page 6 line 19 of right upper column of J P,A 118143/1989.

In the diamine derivatives represented by the general formula (Ia), examples of preferable compound included in benzidine derivatives of n=2, are 4,4'-bis(N,N-diphenylamino)biphenyl,
4,4'-bis[N-(3-methylphenyl)-N-phenylamino]biphenyl,
4,4'-bis[N-(3-methoxyphenyl)-N-phenylamino]biphenyl,
4,4'-bis[N-(3-chlorophenyl)-N-phenylamino]biphenyl,
4-[N-(2-methylphenyl)-N-phenylamino]-4'-[N-(4-methylphenyl)-N-phenylamino]biphenyl,
4-[N-(2-methylphenyl)-N-phenylamino]-4'-[N-(3-methylphenyl)-N-phenylamino]biphenyl,
3,3'-dimethyl-4,4'-bis[N,N'-di(4-methylphenyl)amino]-biphenyl
3,3'-diethyl-4,4'-bis[N,N'-di(4-methylphenyl)amino]-biphenyl and the like, and other diamine derivatives are exemplified in Page 6 line 2 of left lower column to Page 8 line 6 of right upper column of J P,A 118143/1989.

In the diamine derivatives represented by the general formula (Ia), examples of preferable compound included in 4,4''-terphenyldiamine derivatives of n=3, are 4,4''-bis(N,N-diphenylamino)-1,1':4',1''-terphenyl, 4,4''-bis[N-(3-methylphenyl)-N-phenylamino)-1,1':4',1''-terphenyl and the like, and other diamine derivatives are exemplified in Page 8 line 9 of right upper column to Page 9 line 15 of right lower column of J P,A 118143/1989.

In the diamine derivatives represented by the general formula (b), examples of preferable compound included in p-phenylenediamine derivatives of n=1, are 1-[N-(3,5-dimethylphenyl)-N-phenylamino]-4-(N,N-diphenylamino)benzene,
1-[N,N-di(3,5-dimethylphenyl)amino]-4-(N,N-diphenylamino)benzene,
1,4-bis[N-(3,5-dimethylphenyl)-N-phenylamino]benzene and the like, and other diamine derivatives are exemplified in Page 4 line 16 of left lower column to Page 6 line 17 of left lower column of J P,A 118144/1989.

In the diamine derivatives represented by the general formula (Ib), examples of preferable compound included in benzidine derivatives of n=2, are 4,4-bis[N-(3,5-dimethylphenyl)-M-phenylamino]biphenyl,
4,4-bis[N-(3,5-dimethoxyphenyl)-M-phenylamino]-biphenyl,
4,4-bis[N-(3,5-dichlorophenyl)-N-phenylamino]biphenyl,
4,4-bis[N-(3,5-dimethylphenyl)-N-(3-methylphenyl-)amino]biphenyl,
4-[N-(2,4-dimethylphenyl)-N-phenylamino]-4'-[N-(3,5-dimethylphenyl)-N-phenylamino]biphenyl and the like, and other diamine derivatives are exemplified in Page 6 line 20 of left lower column to Page 8 line 19 of left lower column of J P,A 118144/1989.

In the diamine derivatives represented by the general formula (Ib), examples of preferable compound included in 4,4''-terphenyldiamine derivatives of n=3, are 4,4''-bis[N-(3,5-dimethylphenyl)-N-phenylamino]-1,1':4',1''terphenyl,
4-[N-(3,5-dimethylphenyl)-N-phenylamino]-4''-(N,N-diphenylamino)1,1':4',1''-terphenyl,
4-[N,N-bis(3,5-dimethylphenyl)amino]-4''-(N,N-diphenylamino)1,1':4',1''-terphenyl and the like, and other diamine derivatives are exemplified in Page 8 line 2 of right lower column to Page 10 line 3 of right upper column of J P,A 118144/1989.

In the diamine derivatives represented by the general formula (Ic), examples of preferable compound included in p-phenylenediamine derivatives of n=1, are 1,4-bis[N-(6-methylnaphthyl)-N-phenylamino]benzene,
1,4-bis(N-naphthyl-N-phenylamino)benzene,
1-(N-naphthyl-N-phenylamino)-4-[N-(6-methylnaphthyl)-N-phenylamino]benzene and the like, and other diamine derivatives are exemplified in Page 4 line 8 of left lower column to Page 6 line 12 of left upper column of J P,A 118145/1989.

In the diamine derivatives represented by the general formula (Ic), examples of preferable compound included in benzidine derivatives of n=2, are 4,4'-bis(N-naphthyl-N-phenylamino)biphenyl,
4,4'-bis[N-(6-methylnaphthyl)-N-phenylamino]biphenyl,
4,4'-bis[N-(6-methoxynaphthyl)-N-phenylamino]biphenyl,
4,4'-bis[N-(6-chloronaphthyl)-N-phenylamino]biphenyl,
4,4'-bis[N-(6-methylnaphthyl)-N-(3-methylphenyl-)amino]biphenyl,
4-[N-(6-methylnaphthyl)-N-phenylamino]-4'-[N-(6-methylnaphthyl)-N-(3-methylphenyl)amino]biphenyl,
4-N-(4-methylnaphthyl)-N-phenylamino]-4'-[N-(6-methylnaphthyl)-N-phenylamino]biphenyl and the like, and other diamine derivatives are exemplified in Page 6 line 15 of left upper column to Page 7 line 1 of left lower column of J P,A 18145/1989.

In the diamine derivatives represented by the general formula (Ic), examples of preferable compound included in 4,4''-terphenyldiamine derivatives of n=3, are 4,4''-bis(N-naphthyl-N-phenylamino)-1,1':4',1''-terphenyl,
4,4''-bis[N-(6-methylnaphthyl)-N-phenylamino]-1,1':4',1''-terphenyl and the like, and other diamine derivatives are exemplified in Page 7 line 5 of left lower column to Page 8 line 5 of right lower column of J P,A 118145/1989.

And, in the diamine derivatives represented by the general formula (Id), examples of preferable compound included in p-phenylenediamine derivatives of n=1, are 1,4-bis(N,N-dinaphthylamino)benzene,
1-(N,N-dinaphthylamino)-4-[N-(6-methylnaphthyl)-N-naphthylamino]benzene,
1,4-bis[N-(6-methylnaphthyl)-N-naphthylamino]benzene and the like, and other diamine derivatives are exemplified in Page 4 line 10 of left lower column to Page 6 line 3 of right lower column of J P,A 118146/1989.

In the diamine derivatives represented by the general formula (Id), examples of preferable compound included in benzidine derivatives of n=2 are 4,4'-bis[N,N-di(6-methylnaphthyl)amino]biphenyl,
4,4'-bis[N-(6-methylnaphthyl)-N-naphthylamino]biphenyl,
4,4'-bis[N-(6-methoxynaphthyl)-M-naphthylamino]-biphenyl,
4,4'-bis[N-(6-chloronaphthyl)-N-naphthylamino]biphenyl,
4-[N,N-di(6-methylnaphthyl)amino]-4'-[N-(6-methylnaphthyl)-N-naphthylamino]biphenyl,
4-[N-(4-methylnaphthyl)amino-N-naphthylamino]4'-[N-(6-methylnaphthyl)-N-naphthylamino]biphenyl and the like, and other diamine derivatives are exemplified in Page 6 line 5 of right lower column to Page 8 line 13 of right lower column of J P,A 118146/1989.

In the diamine derivatives represented by the general formula (Id), examples of preferable compound included in 4,4''-terphenyldiamine derivatives of n=3, are 4,4''-bis(N,N-dinaphthylamino)-1,1':4',1''-terphenyl,
4,4''-bis[N-(6-methylnaphthyl)-N-naphthylamino]-1,1':4',1''terphenyl and the like, and other diamine derivatives are exemplified in Page 8 line 16 of right lower column to Page 10 line 13 of right lower column of J P,A 118146/1989.

The diamine derivatives represented by the general formula (Ia) to (Id) may be used either single or jointly in the form of a mixture of two or more members. And the diamine derivatives aforementioned are not only having symmetrical molecular structure, taking no part in isomerization reaction caused by light irradiation and providing stability for light but showing large drift mobility and low electric field strength dependency.

Especially among aforementioned diamine derivatives. 3,3'-dimethyl-4,4'-bis[N,N'-di(4-methylphenyl-)amino]biphenyl represented by the following general formula (Ie) is excel in stability for light and drift mobility, preferably is applied to the electrophotosensitive material of this invention.

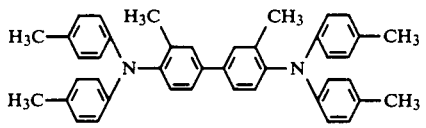

(Ie)

Furthermore, to the mixture containing the aforementioned diamine derivatives, at least one selected from the group consisting of hydrazone compounds represented by the general formula (II), fluorene compounds represented by the general formula (III) and m-phenylenediamine compounds represented by the general formula (IV) is added, or to the mixture containing the aforementioned diamine derivatives and fluorene compounds represented by the general formula (III) and one compound selected from the group consisting of hydrazone compounds represented by the general formula (II) and m-phenylenediamine compounds represented by the general formula (IV) is added, to obtain the electrophotosensitive material preventing from surface potential becoming low by reproducing copy process, and maintained stabilized surface potential.

Examples of lower alkyl group in the compounds represented by the general formula (II), (III) and (IV) are the same alkyl groups having 1 to 6 carbon atoms mentioned above. Examples of lower alkoxy group in the compound represented by the general formula (IV) are the same alkoxy groups having 1 to 6 carbon atoms above mentioned. Examples of halogen atom in the compound represented by the general formula (IV) are the same halogen atoms above mentioned.

Examples of hydrazone compounds represented by the general formula (II) include 3-carbazolylaldehyde-N,N-diphenylhydrazone,
N-methyl-3-carbazolylaldehyde-N,N-diphenylhydrazone,
N-ethyl-3-carbazolylaldehyde-N,N-diphenylhydrazone,
N-propyl-3-carbazolylaldehyde-N,N-diphenylhydrazone,
N-isopropyl-3-carbazolylaldehyde-N,N-diphenylhydrazone,
N-butyl-3-carbazolylaldehyde-N,N-diphenylhydrazone,
N-isobutyl-3-carbazolylaldehyde-N,N-diphenylhydrazone,
N-tert-butyl-3-carbazolylaldehyde-N,N-diphenylhydrazone,
N-pentyl-3-carbazolylaldehyde-N,N-diphenylhydrazone,
N-hexyl-3-carbazolylaldehyde-N,N-diphenylhydrazone and the like, preferably N-methyl-3-carbazolylaldehyde-N,N-diphenylhydrazone.

Examples of the fluorene compound represented by the general formula (III) include 9-carbazolyliminofluorene,
9-(3-methylcarbazolylimino)fluorene,
9-(3,6-dimethylcarbazolylimino)fluorene,
9-(3,6-diethylcarbazolylimino)fluorene,
9-(3-ethyl-6-methylcarbazolylimino)fluorene,
9-(3,6-dipropylcarbazolylimino)fluorene,
9-(3,6-diisopropylcarbazolylimino)fluorene,
9-(3,6-dibutylcarbazolylimino)fluorene,
9-(3,6-diisobutylcarbazolylimino)fluorene,
9-(3,6-di-tert-butylcarbazolylimino)fluorene,
9-(3,6-dipentylcarbazolylimino)fluorene,
9-(3,6-dihexylcarbazolylimino)fluorene,
9-(3,6-dimethylcarbazolylimino)-3-methylfluorene,
9-(3,6-dimethylcarbazolylimino)-3,6-dimethylfluorene,
9-(3,6-dimethylcarbazolylimino)-3,6-diethylfluorene,
9-(3,6-dimethylcarbazolylimino)-3-ethylfluorene and the like, preferably 9-carbazolyliminofluorene.

Examples of m-phenylenediamine compounds represented by the general formula (IV) include N,N,N',N'-tetraphenyl-1,3-phenylenediamine,
N,N,N',N'-tetrakis(3-tolyl)-1,3-phenylenediamine,
N,N,N',N'-tetraphenyl-3,5-tolylenediamine,
N,N,N',N'-tetrakis(3-tolyl)-3,5-tolylenediamine,
N,N,N',N'-tetrakis(4-tolyl)-1,3-phenylenediamine,
N,N,N',N'-tetrakis(4-tolyl)-3,5-tolylenediamine,
N,N,N',N'-tetrakis(3-ethylphenyl)-1,3-phenylenediamine,
N,N,N',N'-tetrakis(4-propylphenyl)-1 3-phenylenediamine, N,N,N',N'-tetraphenyl-5-methoxy-1 3-phenylenediamine,
N,N-bis(3-tolyl)-N',N'-diphenyl-1,3-phenylenediamine,
N,N'-bis(4-tolyl)-N,N'-diphenyl-1.3-phenylenediamine,
N,N'-bis(4-tolyl)-N,N'-bis(3-tolyl)-1,3-phenylenediamine.
N,N'-bis(4-tolyl)-N,N'-bis(3-tolyl)-3,5-tolylenediamine,
N,N'-bis(4-ethylphenyl)-N N'-bis(3-ethylphenyl)-1,3-phenylenediamine,
N,N'-bis(4-ethylphenyl)-N,N'-bis(3-ethylphenyl)-3,5-tolylenediamine,
N,N,N',N'-tetrakis(2,4,6-trimethylphenyl)-1,3-phenylenediamine,
N,N,N',N'-tetrakis(2,4,6-trimethylphenyl)-3,5-tolylenediamine,
N,N,N',N'-tetrakis(3,5-dimethyl)-1,3-phenylenediamine,
N,N,N', N'-tetrakis(3,5-dimethyl)-3,5-tolylenediamine,
N,N,N',N'-tetrakis(3,5-diethyl)-1.3-phenylenediamine,
N,N,N',N'-tetrakis(3,5-diethyl)-3,5-tolylenediamine,
N,N,N',N'-tetrakis(3-chlorophenyl)-1.3-phenylenediamine,
N,N,N',N'-tetrakis(3-bromophenyl)-1,3-phenylenediamine,
N,N,N',N'-tetrakis(3-iodophenyl)-1,3-phenylenediamine,
N,N,N',N'-tetrakis(3-fluorophenyl)-1,3-phenylenediamine and the like. Preferably, the compounds wherein $R^{15}$, $R^{16}$, $R^{18}$ and $R^{19}$ in the general formula (IV) are substituted at meta-position to the nitrogen atom, or wherein $R^{15}$ and $R^{19}$ are substituted at para-position, and $R^{16}$ and $R^{19}$ are substituted at meta-position to the nitrogen atom, are used, because these compound have a property hard to crystallize, and are enough dissolved in the binding resin for the reason of low mutual interaction of molecules of these compounds and conversely high interaction between molecule cf these compounds and the binding resin due to inferiority in symmetry of molecular structure, and more preferably N,N'-bis(3-tolyl)-N,N'-bis(4-tolyl)-1,3-phenylenediamine is used.

The mixing ratio of the compounds above mentioned is adjusted in accordance with the characteristics of the electrophotosensitive material. When the hydrazone compound is used, it is preferable that the diamine derivatives as charge-transferring material and hydrazone compound are contained in the photosensitive layer in weight ratio of 95:5 to 90:10.

When the fluorene compound is used, it is preferable, that the diamine derivatives as charge-transferring material and fluorene compound are contained in the photosensitive layer in weight ratio of 90:10 to 80:20.

When the m-phenylenediamine compound is used, it is preferable, that the diamine derivatives as charge-transferring material and m-phenylenediamine compound are contained in the photosensitive layer in weight ratio of 75:25 to 25:75, more preferably in weight ratio of 70:30 to 50:50.

When the compounds above mentioned are contained in the photosensitive layer less than above mentioned ratio, the electrophotosensitive material does not have enough stability for reproducing. When the compounds above mentioned are contained in the electrophotosensitive material more than above mentioned ratio, the stability for reproducing of the photosensitive layer become high, however, the electrophotosensitive material does not have enough sensitivity.

The electrophotosensitive material of the present invention may have the function separated type photosensitive layer separated in charge-generating function and charge-transferring function, because of enhancing the sensitivity of the electrophotosensitive material. Examples of the separated function type photosensitive layer include single layer type and multilayer type. The present electrophotosensitive material may be applied as either a electrophotosensitive material of a single layer type in which a single photosensitive layer dispersing a charge-generating material, the diamine derivatives and the like in a binding resin is disposed on the conductive substrate, or multilayer type electrophotosensitive material in which at least two layers of a charge-generating layer containing the charge-generating material and a charge-transferring layer containing a charge-transferring material such as the diamine derivatives are laminated on the conductive substrate.

Examples of the charge-generating material include selenium, selenium-tellurium, amorphous silicon, pyrylium salt, azo compound, bis-azo compound, phthalocyanine compound, dibenzopylene compound, perylene compound, indigo compound, triphenylmethane compound, indanthrene compound, toluidine compound, pyrazoline compound, quinacridone compound, pyrrolopyrrole compound and the like. To obtain the electrophotosensitive material presenting high sensitivity and low residual potential, it is preferably that the dibenzopylene compound or perylene compound is used as charge-generating material. Meanwhile, these charge-generating materials may be used either alone or in combination of plural types.

The dibenzopylene compounds are represented by the following general formula (V):

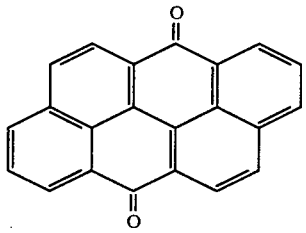

(V)

The dibenzopylene compounds represented by the general formula (V) may have 1 to 4 substituents selected from the group consisting of halogen atoms and alkoxy group above mentioned.

Examples of the dibenzopylene compounds include
dibenzo[def,mno]chrysene-6,12-dion,
2,8-dichloro-dibenzo[def,mno]chrysene-6,12-dion,
4,10-dichloro-dibenzo[def,mno1chrysene-6,12-dion,
2,4,8,10-tetrachloro-dibenzo[def,mno]chrysene-6,12-dion,
2,8-dibromo-dibenzo[def,mno]chrysene-6,12-dion,
4,10-dibromo-dibenzo[def,mno]chrysene-6,12-dion,
2,4,8,10-tetrabromo-dibenzo[def,mno]chrysene-6,12-dion,
2,8-dichloro-4,10-dibromo-dibenzo[def,mno]chrysene-6,12-dion,
2,8-dimethoxy-dibenzo[def,mno]chrysene-6,12-dion,
4,10-dimethoxy-dibenzo[def,mno]chrysene-6,12-dion,
4,10-diethoxy-dibenzo[def,mno]chrysene-6,12-dion,
2,8-diethoxy-dibenzo[def,mno]chrysene-6,12-dion,
2,4,8,10-tetramethoxy-dibenzo[def,mno]chrysene-6,12-dion, 2,4,8,10-tetraethoxy-dibenzo[def,mno]chrysene-6,12-dion,
2,8-dimethoxy-4,10-diethoxy-dibenzo[def,mno]chrysene-6,12-dion,
4,10-dipropoxy-dibenzo[def,mno]chrysene-6,12-dion,
4,10-diisopropoxy-dibenzo[def,mno]chrysene-6,12-dion,
4,10-dibutoxy-dibenzo[def,mno]chrysene-6,12-dion,
4,10-diisobutoxy-dibenzo[def,mno]chrysene-6,12-dion,
4,10-di-tert-butoxy-dibenzo[def,mno]chrysene-6,12-dion,
4,10-dipentyloxy-dibenzo[def,mno]chrysene-6,12-dion,
4,10-dihexyloxy-dibenzo[def,mno]chrysene-6,12-dion and the like, preferably 4,10-dibromo-dibenzo[def,mno]chrysene-6,12-dion.

The dibenzopylene compounds having halogen atom or alkoxy group as substituent may be difficult to isolate and purify, and may not be decided the position of the substituent.

The dibenzopylene compounds represented by the general formula (V) may be used alone or in combination of plural types.

In the perylene compounds are represented by the following general formula (VI), alkyl groups as $R^1$ to $R^4$ are the same alkyl groups having 1 to 6 carbon atoms as above mentioned.

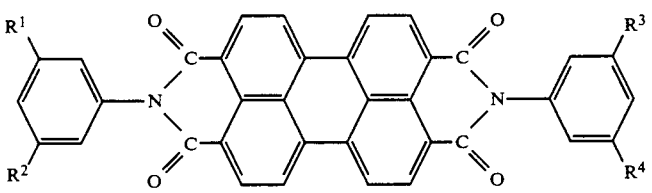

(VI)

Examples of the perylene compound include
N,N'-bis(3,5-dimethylphenyl)perylene-3,4,9,10-tetracarboxydiimido,
N,N'-bis(3-methyl-5-ethylphenyl)perylene-3,4,9,10-tetracarboxydiimido,
N,N'-bis(3,5-diethylphenyl)perylene-3,4,9,10-tetracarboxydiimido,
N,N'-bis(3,5-dipropylphenyl)perylene-3,4,9,10-tetracarboxydiimido,
N,N'-bis(3,5-diisopropylphenyl)perylene-3,4,9,10-tetracarboxydiimido,
N,N'-bis(3-methyl-5-isopropylphenyl)perylene-3,4,9,10-tetracarboxydiimido,
N,N'-bis(3,5-dibutylphenyl)perylene-3,4,9,10-tetracarboxydiimido,
N,N'-bis(3 5-di-tert-butylphenyl)perylene-3,4,9,10-tetracarboxydiimido,
N,N'-bis(3,5-dipentylphenyl)perylene-3,4,9,10-tetracarboxydiimido,
N,N'-bis(3,5-dihexylphenyl)perylene-3,4,9,10-tetracarboxydiimido and the like, preferably N,N'-bis(3,5-dimethylphenyl)perylene-3,4,9,10-tetracarboxydiimido.

The perylene compounds represented by the general formula (VI) may be used alone or in combination of plural types.

The perylene compounds and dibenzopylene compounds do not have spectro-sensitivity in the range of the long wave-length of light, it is preferable that oxotitanilphthalocyanine or metal-free phthalocyanine having spectro-sensitivity in long wavelength of light was added to the charge-generating material of this invention to obtain the electrophotosensitive material showing high sensitivity in combination with halogen lamp having high red spectro-energy.

Examples of the oxotitanilphthalocyanine are the compounds represented by the following general formula (VII) having various crystal forms such as α-type, β-type, γ-type, δ-type, ε-type and the like,

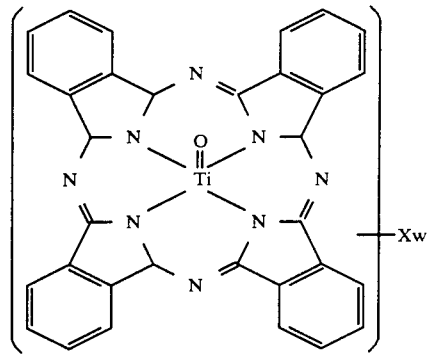

(VII)

(wherein X is halogen atom, w is 0 or integer not less than 1,) preferably the α-type oxotitanilphthalocyanine, wherein X is bromine atom or chlorine atom, w is 0, and Blagg scattering angle ($2\theta \pm 0.2°$) in an X-ray diffraction spectrum shows strong diffraction peaks in 6.9°, 9.6°, 15.6°, 17.6°, 21.9°, 23.6°, 24.7° and 28.0° and strongest diffraction peak in 6.9°.

When the electrophotosensitive material contains aforementioned oxotitanilphthalocyanine and perylene compound, to 100 parts by weigh of perylene compounds 0.62 to 1.88 parts by weight of aforementioned oxotitanilphthalocyanine is added to obtain the electrophotosensitive material having high sensitivity in combination with halogen lamp having high red spectro-energy. However, if the electrophotosensitive material contained oxotitanilphthalocyanine less than 0.62 part by weight to 100 parts by weight of perylene compound, the spectro-sensitivity of that is not spread to long wave-length side, conventionally, if it contains oxotitanilphthalocyanine more than 1.88 parts by weight to 100 parts by weight of perylene compound, the spectro-sensitivity of it becomes too high to reduce the copying performance of red color original.

A preferable metal free phthalocyanine used in this invention is X-type metal-free phthalocyanine having a strong diffraction peak in Blagg scattering angle ($2\theta \pm 0.2°$) of 7.5°, 9.1°, 16.7°, 17.3° and 22.3° in an X-ray diffraction spectrum.

When the electrophotosensitive material contains aforementioned X-type metal-free phthalocyanine and perylene compound, to 100 parts by weigh of perylene compounds. 1.25 to 3.57 parts by weight of aforementioned X-type metal-free phthalocyanine is added to obtain the electrophotosensitive material having high sensitivity on combinating with halogen lamp having high red spectro-energy. However, if the electrophotosensitive material containes X-type metal-free phthalocyanine in the range of less than 1.25 parts by weight to 100 parts by weight of perylene compound, spectro-sensitivity of that is not spread to long wave-length side, conversely, if X-type metal-free phthalocyanine in contained more than 3.75 parts by weight to 100 parts by weight of perylene compound, the spectro-sensitivity of it becomes too high to reduce the copying performance of red color original.

Examples of the binding resin include styrene polymers, acryl polymers, styrene-acryl copolymers, olefin polymers such as polyethylene, ethylene-vinyl acetate copolymers, chlorinated polyethylene, polypropylene, ionomer and the like; polyvinyl chloride, vinylchloride-vinylacetate copolymer, polyester, alkyd resin, polyamide, polyurethane, epoxy resin, polycarbonate, polyallylate, polysulfone, diallylphthalate resin, silicone resin, ketone resin, polyvinyl-butyral resin, polyether resin, phenol resin, photosetting resin such as epoxy-acrylate and other polymers, and especially poly(4,4'-cyclohexylidenediphenyl) carbonate is preferably employed because of characteristics wherein providing wide selectivity for the solvent capable of dissolving the binding resin, enhancing sensitivity, resistance for abrasion and reproductivity of the photosensitive material. The poly(4,4'-cyclohexylidenediphenyl)carbonate allows tetrahydrofurane, methylethylketon and the like to use as the solvent thereof recommendable from safety and healthy also handy points of view, which are completely differ from bisphenol-A-type polycarbonate for which only chlorinated solvent such as dichloromethane, monochlorobenzene and the like, can be used.

For the poly(4,4'-cyclohexylidenediphenyl)carbonate, it is preferably having 15,000 to 25,000 of molecular weight and 58° of glass transition point.

When the photosensitive layer of the single layer type electrophotosensitive material is made with above mentioned diamine derivative, charge generating material and binding resin, the mixing ratio of these materials is not limited and decided in accordance with the desired characteristics of the electrophotosensitive material. The preferably mixing ratios of these materials are, 2 to 20 parts by weight, more preferably 3 to 15 parts by weight, of the charge generating-material, 40 to 200 parts by weight, more preferably 50 to 100 parts by weight, of the diamine derivatives to 100 parts by weight of the binding resin. When the mixing ratios of the charge-generating material and the diamine derivatives are less than above mentioned ratios, the electrophotosensitive material is not presented enough sensitivity and high residual potential. On the other hand, when the mixing ratios of the charge-generating material and the diamine derivatives are more than above mentioned ratios, the electrophotosensitive material is not presented enough resistance for abrasion.

An antioxidant is capable of well resisting degradation of the electro-transferring material wherein having a chemical structure affected easily from oxidizing.

Examples of the antioxidant include, phenol antioxidants such as, 2,6-di-tert-butyl-p-cresol, triethyleneglycol-bis[3-(3-tert-butyl-5-methyl-4-hydroxyphenyl)propyonate], 1,6-hexanediol-bis[3,-(3,5-di-tert-butyl-4-hydroxyphenyl)propyonate], pentaerythrityl-tetrakis[3-(3,5-di-tert-butyl-4-hydroxyphenyl)propyonate], 2,2-thio-diethylene-bis[3-(3,5-di-tert-butyl-4-hydroxyphenyl)propyonate], 2,2-thiobis(4-methyl-6-tert-butylphenol), N,N'-hexamethylene-bis(3,5-di-tert-butyl-4-hydroxyhydrocyanoamido)

and 1,3,5-trimethyl-2,4,6-tris(3,5-di-tert-butyl-4-hydroxybenzyl)benzene, preferably 2,6-di-tert-butyl-p-cresol.

The thickness of the photosensitive layer of the single layer type electrophotosensitive material referring to this invention may be adequately decided, but is preferably 15 to 30 μm, more preferably 18 to 27 μm.

The photosensitive layer of the single layer type electrophotosensitive material is obtained by preparing a coating solution containing these components, applying it on the conductive material and drying to remove its solvent.

The electrophotosensitive material having multilayer type photosensitive layer is obtained by forming the charge-generating layer and the charge-transferring layer on the conductive substrate. To form the charge-generating layer, the coating solution containing charge-generating material and binding resin, was coated and dried. To form the charge-transferring layer, the coating solution containing diamine derivatives as charge transferring materials, at least one compound selected from the group consisting of the hydrazone compound, fluorene compound and m-phenylenediamine compound, and binding resin, was coated and dried. The charge-generating layer is in thickness of about 0.1 to 5 μm. The charge-transferring layer is in thickness of 5 to 50 μm, preferably 10 to 20 μm.

The charge-generating layer of the multilayer type electrophotosensitive material may be made by vapor deposition or sputtering the charge generating material without using coating solution.

The conductive substrate may be formed in various shapes such as a sheet or drum.

As the conductive substrate, various conductive materials may be used. Examples of the conductive materials include anodized or not anodized aluminum, aluminum alloy, copper, tin, platinum, gold silver, vanadium, molybdenum, chromium, cadmium, titanium, nickel, palladium, indium, stainless steel, brass and the like; plastic materials or glass materials which is plated or laminated with above mentioned metal; or coated with iodide aluminum, tin oxide, indium oxide or the like, preferably the anodized aluminium sealing with nickel acetate.

The conductive substrate may treated with a surface treatment agent such as silane-coupling agent, titanate-coupling agent and the like, as needed, to improve adhesiveness to photosensitive layer.

On preparing above mentioned coating solution, the various organic solvent may be used in accordance with the binding resin and the like.

Examples of the solvent include alcohols such as methanol, ethanol, propanol, isopropanol, butanol and the like; aliphatic hydrocarbons such as n-hexane, octane, cyclohexane and the like; aromatic hydrocarbons such as benzene, toluene, xylene and the like; halogenated hydrocarbons such as dichloromethane, dicholroethane, carbon tetrachloride, chlorobenzene and the like; ethers such as tetrahydrofurane, ethylene glycol dimethyl ether, ethylene glycol diethyl ether, and the like; ketones such as acetone, methyl ethyl ketone, cyclohexanone and the like; esters such as ethyl acetate, methyl acetate and the like. These solvents are used either alone or in combination of two or more types.

Besides, when preparing such coating solutions, in order to enhance the sensitivity, sensitization agents such as terphenyl, halonaphtoquinone, acetylnaphthylene and the like, may be used, and in order to enhance the dispersing ability or coating performance of these coating solutions, surface active agents or leveling agent such as silicone oil may be used, polydimethylsiloxane is preferably used as silicone oil.

Upon preparation of coating solutions to form the electrophotosensitive material by applying method, above mentioned materials are mixed with binding resin and the like by using conventional methods such as paint-shaker, mixer, a roll mill, a ball mill, a sand mill, an attriter or a supersonic dispenser. To obtain the electrophotosensitive material, the coating solution is applied on the conductive substrate by various conventional methods such as dip coating method, spray coating method, spin coating method, roller coating method, blade coating method, curtain coating method, bar coating method and the like.

EXAMPLES

The invention is described in further details by reference to the following Examples and Comparative Examples.

Example 1 to 15, Comparative Example 1 to 4

To the following components, both of charge-transferring material shown in Table 1 and at least one compound selected from the group consisting of the compounds represented by one of the formulas (II) to (IV) shown in the column of "Compound II to IV" of Table 1 were mixed and dispensed by supersonic dispenser to obtain the coating solution for single layer-type photosensitive material.

This coating solution was applied to the aluminium substrate having 8 μm of anoded surface layer, heated about 100° C. and obtained the electrophotosensitive material having 23 μm of single layer-type photosensitive layer.

| | |
|---|---|
| Charge-generating materials: | |
| (1) 4,10-dibromo-dibenzo[def,mno]-chrysene-6,12-dion | 8 parts by weight |
| (2) X-type metal free phthalocyanine | 0.2 parts by weight |
| Binding resin: poly-(4,4'-cyclohexylidenediphenyl)-carbonate | 100 parts by weight |
| Antioxidant: 2,6-di-tert-butyl-p-cresol | 5 parts by weight |
| Plasticizer: polydimethylsiloxane | 0.01 parts by weight |
| Solvent: tetrahydrofurane | 600 parts by weight |

Example 16

There was prepared the coating solution for single layer-type photosensitive layer, in the same manner as Example 1, excepting that 0.1 parts by weight of α-type oxotitanilphthalocyanine in the place of 0.2 parts by weight of X-type metal-free phthalocyanine. There was prepared the photosensitive material having single-layer type photosensitive layer in the same manner as Example 1.

In the Table 1, meanings of the symbols in the column of the "Charge-transferring material" are as follows:

| | |
|---|---|
| a: | 3,3'-dimethyl-4,4'-bis[N,N'-di(4-methylphenyl)-amino]biphenyl |
| b: | 3,3'-diethyl-4,4'-bis[N,N'-di(4-methylphenyl)amino] biphenyl |
| c: | 4,4'-bis[N-(3,5-dimethylphenyl)-N-phenylamino]biphenyl |
| d: | 4,4'-bis[N-(6-methylnaphthyl)-N-phenylamino]biphenyl |
| e: | 4,4'-bis[N-(6-methylnaphthyl)-N-naphthylamino]biphenyl |

In the Table 1, meanings of the symbols in the column of "Compound II–IV" are as follows:

| | |
|---|---|
| A: | N-ethyl-3-carbazolylaldehyde-N,N-diphenylhydrazone |
| B: | N-methyl-3-carbazolylaldehyde-N,N,-diphenylhydrazone |
| C: | 9-carbazolyliminofluorene |
| D: | N,N,N',N'-tetrakis(3-tolyl)-1,3-phenylenediamine |
| E: | N,N'-bis(4-tolyl)-N,N'-bis(3-tolyl)-1,3-phenylenediamine |

The electrophotosensitive materials of the Example 1 to 16 and Comparative Example 1 to 4 were examined as follows.

Test for the initial surface potential

The electrophotosensitive materials obtained in Example 1 to 16 and Comparative Example 1 to 4 were set in the electrostatic test copier (produced by Genetic Co.; Genetic Cincia 30M), positive charged then the initial surface potential: $V_1$ s.p.(V) of each electrophotosensitive material was measured.

Test for the half-life exposure and the residua) potential

At the same time, the surface of the electrophotosensitive material was exposed to light from a halogen lamp which was the exposing lamp of the electrostatic test copier, to clock the time required for the aforementioned surface potential: $V_1$ s.p., to decrease to ½ the initial magnitude and calculated the half-life exposure: E ½ (μJ/cm²). The surface potential measured on after 0.15 second and following the exposure was reported as residual potential: V r.p. (V).

Measurement of the surface potential charge after repeated exposures

The above electrophotosensitive materials were set in the copying apparatus (DC-111 of Mita Co.) and 1000 copies were reproduced, and by positive charging the surface of the electrophotosensitive materials, the surface potential was measured as the surface potential: $V_2$ s.p. (V).

Test for the copying performance of red color

The electrophotosensitive materials were set in the copying apparatus (DC-111 of Mita Co.), copied a gray colored original having the same reflection density of the red one, and calculating following expression:

$$\frac{\text{the reflection density of the copy}}{\text{the reflection density of gray colored original}} \times 100$$

The result of the above mentioned tests of electrophotosensitive materials are shown in the Table 1.

TABLE 1

| | Charge-transferring material (parts by weight) | Compound II~IV (parts by weight) | $V_1$ s.p. (V) | $E_{\frac{1}{2}}$ ($\mu J/cm^2$) | Vr.p. (V) | $V_2$ s.p. (V) | Copying performance of red color (%) |
|---|---|---|---|---|---|---|---|
| Example 1 | a (95) | A (5) | 695 | 21.5 | 85 | 670 | 98 |
| Example 2 | a (95) | A + C (5) (10) | 715 | 21.5 | 85 | 695 | 98 |
| Example 3 | a (30) | D (70) | 705 | 20.5 | 80 | 695 | 98 |
| Example 4 | a (30) | D + C (70) (10) | 695 | 20.5 | 80 | 680 | 98 |
| Example 5 | a (30) | E (70) | 700 | 20.0 | 90 | 690 | 98 |
| Example 6 | a (95) | B (5) | 695 | 21.5 | 85 | 660 | 98 |
| Example 7 | a (95) | B + C (5) (10) | 715 | 21.5 | 85 | 695 | 98 |
| Example 8 | b (95) | A (5) | 695 | 20.5 | 95 | 660 | 98 |
| Example 9 | b (30) | D (70) | 715 | 18.5 | 80 | 700 | 98 |
| Example 10 | b (30) | D + C (70) (10) | 705 | 19.5 | 90 | 690 | 98 |
| Example 11 | b (30) | E (70) | 695 | 19.0 | 85 | 675 | 98 |
| Example 12 | c (95) | A (5) | 715 | 22.0 | 95 | 685 | 98 |
| Example 13 | d (95) | A (5) | 700 | 22.5 | 100 | 675 | 98 |
| Example 14 | e (95) | A (5) | 690 | 22.5 | 105 | 660 | 98 |
| Example 15 | e (95) | A + C (5) (10) | 700 | 19.0 | 95 | 685 | 98 |
| Example 16 | a (95) | A (5) | 705 | 20.5 | 100 | 675 | 93 |
| Comparative example 1 | a (100) | — (—) | 700 | 20.0 | 80 | 635 | 98 |
| Comparative example 2 | b 100) | — (—) | 700 | 20.5 | 80 | 645 | 98 |
| Comparative example 3 | d (100) | — (—) | 705 | 22.5 | 95 | 640 | 98 |
| Comparative example 4 | — (—) | A (100) | 715 | 26.5 | 115 | 665 | 98 |

The data in Table 1 show that the electrophotosensitive materials of the Example 1 to 16 respectively were excellent in electrification characteristics and having high sensitivity and low residual potential, superior in stability for reproducing and copying performance of red color original.

The data in Table 1 also show that the electrophotosensitive materials of Comparative Example 1 to 3 were inferior in repetition stability of reproduction, and electrophotosensitive material of Comparative Example 4 shows large amounts of half-life exposure and high residual potential.

Example 17 to 42, Comparative Example 5 to 12

To the following components, both of charge-transferring material shown in Table 2 and at least one compounds represented by the formulas (II) to (IV) shown in the column of "Compounds II to IV" in Table 2 were mixed and dispensed by supersonic dispenser to obtain the coating solution for single layer-type photosensitive material.

The electrophotosensitive materials having 23 μm of single layer-type photosensitive layer were obtained in the same manner as Examples 1 by using the obtained coating solution.

| | |
|---|---|
| Charge-generating materials: | |
| (1) N,N'-di(3,5-dimethylphenyl)perylene-3,4,9,10-tetracarboxydiimide | 8 parts by weight |
| (2) X-type metal free phthalocyanine | 0.2 parts by weight |
| Binding resin: poly-(4,4'-cyclohexyridenediphenyl)-carbonate | 100 parts by weight |
| Antioxidant: 2,6-di-tert-butyl-p-cresol | 5 parts by weight |
| Plasticizer: polydimethylsiloxane | 0.01 parts by weight |
| Solvent: tetrahydrofurane | 600 parts by weight |

In the Tables 2, meanings of the symbols at the column of the charge-generating material and the column of the "Compound II to IV" are the same as in the Table 1. The symbol F at the column of the "Compounds II to IV" means N,N-diethylaminobenzaldehyde-N,N-diphenylhydrazone.

The electrophotosensitive materials of Examples 17 to 42 and Comparative Examples 5 to 12 were estimated by above mentioned tests.

The results of the tests were shown in the Tables 2.

TABLE 2

| | Charge-transferring material (parts by weight) | Compound II~IV (parts by weight) | $V_1$ s.p. (V) | $E_{\frac{1}{2}}$ ($\mu J/cm^2$) | Vr.p. (V) | $V_2$ s.p. (V) | Copying performance of red color (%) |
|---|---|---|---|---|---|---|---|
| Example 17 | a (95) | A (5) | 705 | 19.5 | 75 | 670 | 95 |
| Example 18 | a (95) | A + C (5) (10) | 710 | 19.5 | 75 | 685 | 95 |
| Example 19 | a (30) | D (70) | 705 | 18.5 | 70 | 695 | 95 |
| Example 20 | a (30) | D + C (70) (10) | 700 | 18.5 | 70 | 690 | 95 |
| Example 21 | a (70) | E (30) | 705 | 19.0 | 75 | 670 | 95 |
| Example 22 | a (70) | E + C (30) (10) | 700 | 19.5 | 80 | 665 | 95 |
| Example 23 | a (95) | B (5) | 705 | 19.5 | 75 | 670 | 95 |
| Example 24 | a (95) | B + C (5) (10) | 710 | 19.5 | 75 | 685 | 95 |
| Example 25 | b (95) | B (5) | 705 | 20.0 | 85 | 675 | 95 |
| Example 26 | b (95) | B + C (5) (10) | 710 | 20.5 | 80 | 685 | 95 |
| Example 27 | b (30) | D (70) | 690 | 19.0 | 70 | 670 | 95 |
| Example 28 | b (30) | D + C (70) (10) | 715 | 19.0 | 75 | 700 | 95 |
| Example 29 | b (70) | E (30) | 695 | 19.5 | 75 | 670 | 95 |
| Example 30 | b (70) | E + C (30) (10) | 690 | 19.5 | 85 | 665 | 95 |
| Example 31 | c (30) | D (70) | 695 | 20.5 | 90 | 675 | 95 |
| Example 32 | c (30) | D + C (70) (10) | 700 | 20.0 | 90 | 685 | 95 |
| Example 33 | c (95) | B (5) | 700 | 19.5 | 80 | 670 | 95 |
| Example 34 | c (95) | B + C (5) (10) | 690 | 20.0 | 85 | 660 | 95 |
| Example 35 | d (30) | D (70) | 695 | 20.5 | 95 | 680 | 95 |
| Example 36 | d (30) | D + C (70) (10) | 695 | 21.0 | 90 | 675 | 95 |
| Example 37 | d (95) | B (5) | 710 | 21.5 | 95 | 680 | 95 |
| Example 38 | d (95) | B + C (5) (10) | 690 | 21.0 | 95 | 665 | 95 |
| Example 39 | e (30) | D (70) | 690 | 21.5 | 90 | 675 | 95 |
| Example 40 | e (30) | D + C (70) (10) | 705 | 22.0 | 95 | 685 | 95 |
| Example 41 | e (95) | B (5) | 705 | 22.0 | 90 | 670 | 95 |
| Example 42 | e (95) | B + C (5) (10) | 690 | 21.5 | 90 | 670 | 95 |
| Comparative example 5 | a (100) | — (—) | 700 | 18.0 | 70 | 640 | 95 |
| Comparative example 6 | a (95) | F (5) | 695 | 29.5 | 15 | 640 | 95 |
| Comparative example 7 | b (100) | — (—) | 705 | 18.5 | 75 | 650 | 95 |
| Comparative example 8 | c (100) | — (—) | 700 | 19.5 | 80 | 645 | 95 |
| Comparative example 9 | d (100) | — (—) | 705 | 20.5 | 90 | 640 | 95 |
| Comparative example 10 | e (100) | — (—) | 715 | 21.0 | 85 | 655 | 95 |
| Comparative example 11 | — (—) | A (100) | 710 | 24.0 | 95 | 700 | 95 |
| Comparative example 12 | — (—) | B (100) | 710 | 24.0 | 95 | 690 | 95 |

The data in Tables 2 shows that the electrophotosensitive materials of the Examples 17 to 42 were respectively excellent in electrification characteristics and shown high sensitivity and low residual potential, superior in reproducibility and copying performance of red color original.

The data in Tables 2 also shows that electrophotosensitive materials of Comparative Examples 5 to 12 were inferior in repetition stability of reproduction, electrophotosensitive materials of Comparative Examples 6, 11 and 12 showed large half-life exposure, and electrophotosensitive material of Comparative Example 6 showed high residual potential.

Examples 43 to 59. Comparative Examples 13 to 23

To the following components, both of the charge-generating materials shown in Table 3 and the charge transferring material and at least one of the compound represented by the formulas (II) to (IV) shown in the column of "Compounds II to IV" in Tables 3 were mixed and dispensed by supersonic dispenser to obtain the coating solution for single layer-type electrophotosensitive material.

The electrophotosensitive materials having 23 μm of single layer-type photosensitive layer were obtained in the same manner as Example 1 by using the obtained coating solution.

| | |
|---|---|
| Binding resin: poly-(4,4'-cyclohexyridenediphenyl)-carbonate | 100 parts by weight |
| Antioxidant: 2,6-di-tert-butyl-p-cresol | 5 parts by weight |
| Plasticizer: polydimethylsiloxane | 0.01 parts by weight |
| Solvent: tetrahydrofurane | 600 parts by weight |

In the Table 3 the symbol P is means N,N'-di(3,5-dimethylphenyl)perylene-3,4,9,10-tetracarboxydiimido and α means α-type oxotitanilphtalocyanine.

The other symbols in the column of the "Charge-transferring material" and "Compound II to IV" are the same as in Table 1.

The electrophotosensitive material of Examples 43 to 59 and Comparative Examples 13 to 23 were estimated by above mentioned tests.

The test results were shown in the Table 3.

TABLE 3

| | Charge-generating material (parts by weight) | Charge-tranferring material (parts by weight) | Compound II~IV (parts by weight) | $V_1$ s.p. (V) | $E_{\frac{1}{2}}$ (μJ/cm²) | Vr.p. (V) | $V_2$ s.p. (V) | Copying performance of red color (%) |
|---|---|---|---|---|---|---|---|---|
| Example 43 | P + α (8) (0.1) | a (95) | A (5) | 705 | 18.5 | 70 | 675 | 89 |
| Example 44 | P + α (8) (0.15) | a (95) | A (5) | 705 | 17.0 | 70 | 675 | 83 |
| Example 45 | P + α (8) (0.05) | a (95) | A (5) | 695 | 20.0 | 85 | 665 | 100 |
| Example 46 | P + α (8) (0.1) | a (95) | A + C (5) (10) | 705 | 18.5 | 70 | 680 | 89 |
| Example 47 | P + α (8) (0.1) | a (30) | D (70) | 715 | 18.0 | 70 | 700 | 89 |
| Example 48 | P + α (8) (0.1) | a (30) | D + C (70) (10) | 700 | 18.0 | 65 | 690 | 89 |
| Example 49 | P + α (8) (0.1) | a (70) | E (30) | 710 | 19.0 | 75 | 685 | 89 |
| Example 50 | P + α (8) (0.1) | a (70) | E + C (30) (10) | 705 | 19.0 | 75 | 685 | 89 |
| Example 51 | P + α (8) (0.1) | b (30) | D (70) | 700 | 17.5 | 70 | 685 | 89 |
| Example 52 | P + α (8) (0.1) | b (70) | E (30) | 700 | 19.0 | 80 | 685 | 89 |
| Example 53 | P + α (8) (0.1) | b (70) | E + C (30) (10) | 715 | 19.5 | 85 | 690 | 89 |
| Example 54 | P + α (8) (0.1) | b (95) | B (5) | 695 | 18.0 | 75 | 660 | 89 |
| Example 55 | P + α (8) (0.1) | b (95) | B + C (5) (10) | 690 | 18.5 | 75 | 665 | 89 |
| Example 56 | P + α (8) (0.1) | c (95) | B (5) | 700 | 19.5 | 90 | 665 | 89 |
| Example 57 | P + α (8) (0.1) | d (30) | D (70) | 700 | 20.5 | 95 | 685 | 89 |
| Example 58 | P + α (8) (0.1) | d (95) | B + C (5) (10) | 695 | 20.0 | 90 | 680 | 89 |
| Example 59 | P + α (8) (0.1) | e (30) | D (70) | 715 | 20.0 | 95 | 700 | 89 |
| Comparative example 13 | P + α (8) (0.01) | a (95) | A (5) | 715 | 20.5 | 95 | 680 | 80 |
| Comparative example 14 | P + α (8) (0.3) | a (95) | A (5) | 690 | 15.5 | 55 | 660 | 70 |
| Comparative example 15 | P + α (8) (0.01) | b (95) | B (5) | 705 | 20.0 | 95 | 675 | 80 |
| Comparative example 16 | P + α (8) (0.2) | b (95) | B (5) | 690 | 17.0 | 70 | 660 | 79 |
| Comparative example 17 | P + α (8) (0.1) | a (100) | — (—) | 705 | 17.5 | 75 | 645 | 89 |
| Comparative example 18 | P + α (8) (0.1) | b (100) | — (—) | 690 | 18.0 | 75 | 630 | 89 |
| Comparative example 19 | P + α (8) (0.1) | c (100) | — (—) | 715 | 20.5 | 100 | 650 | 89 |
| Comparative example 20 | P + α (8) (0.1) | d (100) | — (—) | 695 | 22.0 | 110 | 635 | 89 |
| Comparative example 21 | P + α (8) (0.1) | e (100) | — (—) | 705 | 22.0 | 110 | 640 | 89 |
| Comparative example 22 | P + α (8) (0.1) | — (—) | A (100) | 690 | 23.0 | 100 | 670 | 89 |

TABLE 3-continued

| | Charge-generating material (parts by weight) | Charge-tranferring material (parts by weight) | Compound II~IV (parts by weight) | $V_1$ s.p. (V) | $E_{\frac{1}{2}}$ ($\mu J/cm^2$) | Vr.p. (V) | $V_2$ s.p. (V) | Copying performance of red color (%) |
|---|---|---|---|---|---|---|---|---|
| Comparative example 23 | P + α (8) (0.1) | — (—) | B (100) | 690 | 23.0 | 100 | 670 | 89 |

The data in Table 3 shows that the electrophotosensitive material of the Examples 43 to 59 were respectively excellent in electrification characteristics and having high sensitivity and low residual potential, superior in reproducibility and copying performance of red color original.

The data in Table 3 also shows that the electrophotosensitive material of the Comparative Examples 13 to 16 were inferior in copying performance of red color original, that of the Comparative Examples 17 to 20 were inferior in reproducibility, that of the Comparative Examples 19 to 20 showed low sensitivity and that of the Comparative Examples 20 to 23 showed large half-life exposure.

What is claimed is:

1. An electrophotosensitive material comprising a photoconductive material, and a photosensitive layer formed thereon containing a charge-generating material in the range of 2 to 20 parts by weight and a charge-transferring material in the range of 40 to 200 parts by weight to 100 parts by weight of a binding resin, said charge-transferring material comprising a diamine derivative represented by the following formula (I), and also containing a hydrazone compound represented by the following formula (II) or a fluorene compound represented by the following formula (III) or a m-phenylenediamine compound represented by the following formula IV:

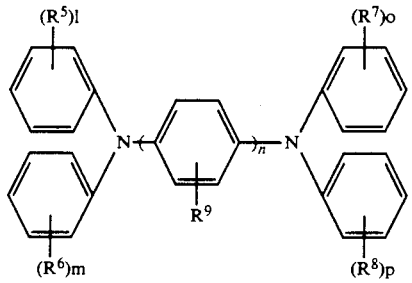

(I)

wherein $R^5$, $R^6$, $R^7$, $R^8$ and $R^9$ are the same or different, hydrogen atom, lower alkyl group, lower alkoxy group or halogen atom, n is an integer from 1 to 3,
l, m, o and p are the same or different, integers from 0 to 2, and at least one selected from the group consisting of following groups:

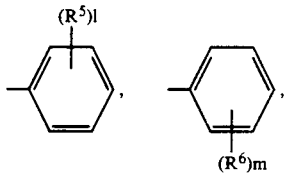

-continued

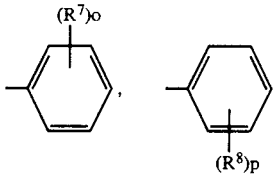

may form a condensed ring with benzene ring which may have lower alkyl group, lower alkoxy group or halogen atom as a substituent;

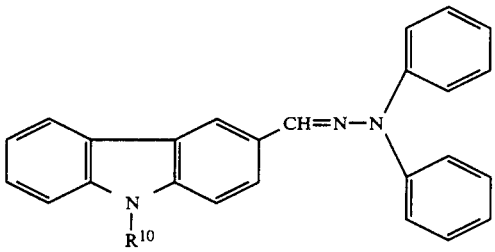

(II)

wherein $R^{10}$ is hydrogen atom or alkyl group, wherein if said hydrazone compound is present then the weight ratio of said diamine derivative to said hydrazone compound is 95:5 to 90:10;

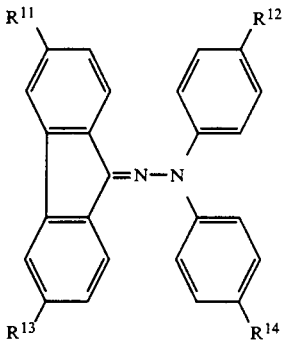

(III)

wherein $R^{11}$, $R^{12}$, $R^{13}$ and $R^{14}$ are the same or different, hydrogen atom or alkyl group, wherein if said fluorene compound is present then the weight ratio of said diamine derivative to said fluorene compound is 90:10 to 80:20;

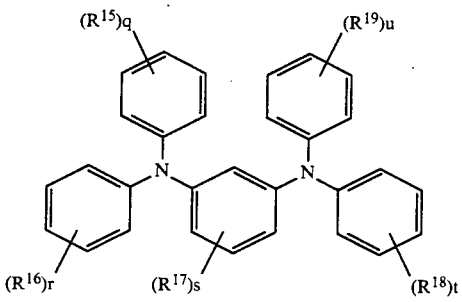

(IV)

wherein $R^{15}$, $R^{16}$, $R^{17}$, $R^{18}$ and $R^{19}$ are the same or different, hydrogen atom, alkyl group, alkoxy group or halogen atom, q, r, t and u are the same or different, integers from 0 to 5, s is an integer from 0 to 4, wherein if said m-phenylenediamine compound is present then the weight ratio of said diamine derivative to said m-phenylenediamine compound is 75:25 to 25:75.

2. The electrophotosensitive material of claim 1 wherein the diamine derivative is represented by the general formula (Ia):

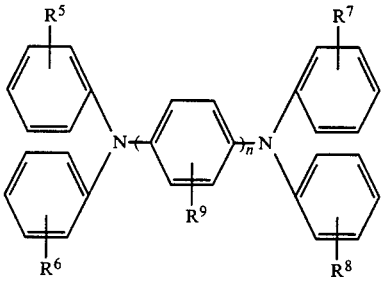

(Ia)

wherein $R^5$, $R^6$, $R^7$, $R^8$ and $R^9$ are the same or different, hydrogen atom, lower alkyl group, lower alkoxy group or halogen atom, n is an integer from 1 to 3.

3. The electrophotensitive material of claim 1 wherein the diamine derivative is represented by the general formula (Ib):

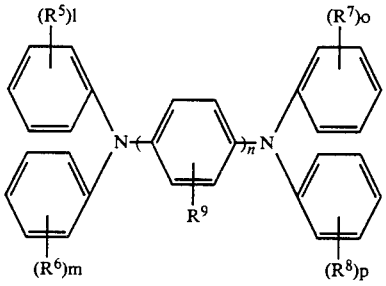

(Ib)

wherein $R^5$, $R^6$, $R^7$, $R^8$ and $R^9$ are the same or different, hydrogen atom, lower alkyl group, lower alkoxy group or halogen atom, n is an integers from 1 to 3,
l, m, o and p are the same or different, integers from 0 to 2, provided that, $R^5$, $R^6$, $R^7$ and $R^8$ are not simultaneously hydrogen atom and at least one of l, m, o and p of $R^5$, $R^6$, $R^7$ and $R^8$ which is not hydrogen atom is 2.

4. The electrophotosensitive material of claim 1 wherein the diamine derivative is represented by the general formula (Ic):

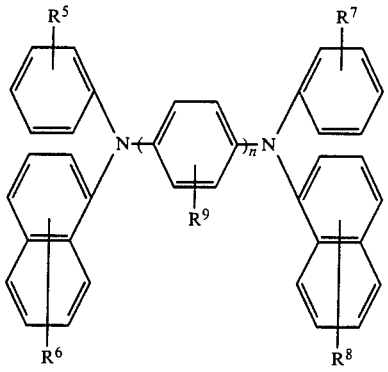

(Ic)

wherein $R^5$, $R^6$, $R^7$, $R^8$ and $R^9$ are the same or different, hydrogen atom, lower alkyl group, lower alkoxy group or halogen atom, and n is an integer from 1 to 3.

5. The electrophotosensitive material of claim 1 wherein the diamine derivative is represented by the general formula (Id):

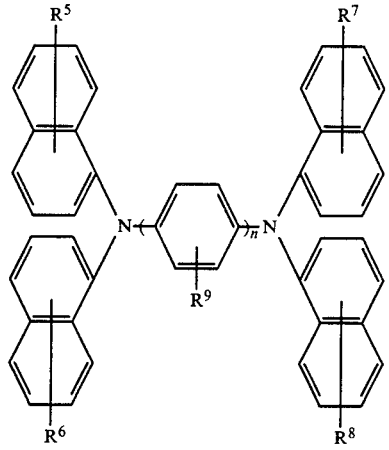

(Id)

wherein $R^5$, $R^6$, $R^7$, $R^8$ and $R^9$ are the same or different, hydrogen atom, lower alkyl group, lower alkoxy group or halogen atom, and n is an integer from 1 to 3.

6. The electrophotosensitive material of claim 1 wherein $R^5$, $R^6$, $R^7$, $R^8$ and $R^9$ of the general formula (I) defined in claim 1 are the same or different, hydrogen atoms, alkyl group having 1 to 4 carbon atoms, alkoxy groups having 1 to 4 carbon atoms or halogen atom.

7. The electrophotosensitive material of claim 1 wherein a diamine derivative is 3,3'-dimethyl-4,4'-bis[N,N'-di(4-methylphenyl)amino]biphenyl represented by the following formula (Ie):

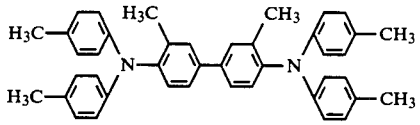

(Ie)

8. The electrophotosensitive material of claim 1 wherein the hydrazone compound is N-methyl-3-carbazolylaldehyde-N,N-diphenylhydrazone.

9. The electrophotosensitive material of claim 1 wherein the fluorene compound is 9-carbazolylimino-fluorene.

10. The electrophotosensitive material of claim 1 wherein the photosensitive layer is contained dibenzopylene compound as charge generating material, represented by the general formula (V), which may have 1 to 4 groups selected from the groups consisting of halogen atom and alkoxy group as substituent.

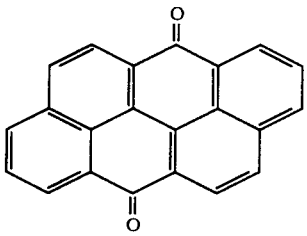

(V)

11. The electrophotosensitive material of claim 10 wherein the dibenzopylene compound is 4,10-dibromodibenzo[def,mno] chrysene-6,12-dion.

12. The electrophotosensitive material of claim 1 wherein the photosensitive layer contains the perylene compound as charge generating material represented by the general formula (VI):

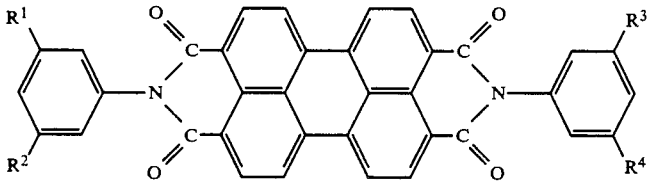

(VI)

wherein the $R^1$, $R^2$, $R^3$ and $R^4$ are the same or different alkyl group.

13. The electrophotosensitive material of claim 12 wherein the perylene compound is N,N'-bis(3,5-dimethylphenyl)perylene-3,4,9,10-tetracarboxydiimido.

14. The electrophotosensitive material of claim 1 wherein the photosensitive layer contains perylene compound represented by the general formula (VI) and oxotitanilphtalocyanine which is contained in the range of 0.62 to 1.88 parts by weight as charge-generating material to 100 parts by weight of perylene compound.

15. The electrophotosensitive material of claim 1 wherein the photosensitive layer contains an antioxidant.

16. The electrophotosensitive material of claim 1 comprising photosensitive layer containing 3,3'-dimethyl-4,4'-bis[N,N-di(4-methylphenyl)amino]biphenyl represented by the formula (Ie) as charge-transferring material, dibenzopylene compound represented by the general formula (V) as charge-generating material and at least one compound selected from the group consisting of hydrazone compound represented by the general formula (II), fluorene compound represented by the general formula (III) and m-phenylenediamine compound represented by the general formula (IV).

17. The electrophotosensitive material of claim 16 wherein the dibenzopylene compound is 4,10-dibromodibenzo[def,mno] chrysene-6,12-dion.

18. The electrophotosensitive material of claim 1 comprising a photosensitive layer containing 3,3'-dimethyl-4,4'-bis[N,N'-di-(4-methylphenyl)amino]-biphenyl represented by the formula (Ie) as charge-transferring material, perylene compound represented by the general formula (VI) as charge-generating material and at least one compound selected from the group consisting of hydrazone compound represented by the general formula (II), fluorene compound represented by the general formula (III) and m-phenylenediamine compound represented by the general formula (IV).

19. The electrophotosensitive material of claim 18 wherein the perylene compound is N,N'-bis(3,5-dimethylphenyl)perylene-3,4,9,10-tetracarboxydiimido.

20. The electrophotosensitive material of claim 1 comprising a photosensitive layer contains 3,3'-dimethyl-4,4'-bis[N,N'-di(4-methylphenyl)amino]biphenyl represented by the general formula (Ie) as charge-transferring material, perylene compounds represented by the general formula (VI) oxotitanilphtalocyanine which is contained within 0.62 to 1.88 parts by weight to 100 parts by weight of perylene compound as charge-generating material, and at least one compound selected from the group consisting of hydrazone compound represented by the general formula (II), fluorene compound represented by the general formula (III) and m-phenylenediamine compound represented by the general formula (IV).

21. The electrophotosensitive material of claim 20 wherein the perylene compound is N,N'-bis(3,5-dimethylphenyl)perylene-3,4,9,10-tetracarboxydiimido, and oxotitanilphtalocyanine is type oxotitanilphtalocyanine.

22. An electrophotosensitive material comprising a photoconductive material, and a photosensitive layer formed thereon containing a charge-generating material in the range of 2 to 20 parts by weight and a charge-transferring material in the range of 40 to 200 parts by weight to 100 parts by weight of a binding resin, said charge-transferring material comprising a diamine derivative represented by the following formula (I), and also containing a hydrazone compound represented by the following formula (III), the weight ratio of said diamine derivative to said hydrazone compound is 95:5 to 90:10:

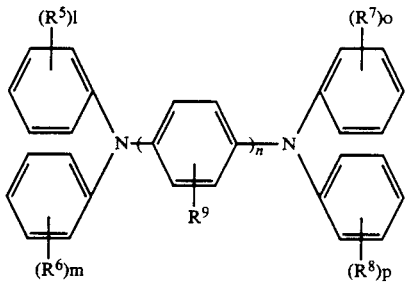

(I)

wherein $R^5$, $R^6$, $R^7$, $R^8$ and $R^9$ are the same or different, hydrogen atom, lower alkyl group, lower alkoxy group or halogen atom, n is an integer from 1 to 3, l, m, o and p are the same or different, integers from 0 to 2, and at least one selected from the group consisting of following groups:

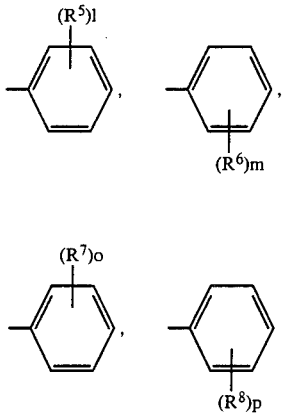

may form a condensed ring with benzene ring which may have lower alkyl group, lower alkoxy group or halogen atom as a substituent;

(II)

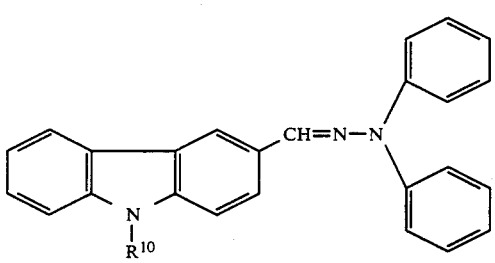

wherein $R^{10}$ is hydrogen atom or alkyl group.

23. An electrophotosensitive material comprising a photoconductive material, and a photosensitive layer formed thereon containing a charge-generating material in the range of 2 to 20 parts by weight and a charge-transferring material in the range of 40 to 200 parts by weight to 100 parts by weight of a binding resin, said charge-transferring material comprising a diamine derivative represented by the following formula (I), and also containing a fluorene compound represented by the following formula (III), the weight ratio of said diamine derivative to said fluorene compound is 90:10 to 80:20:

(I)

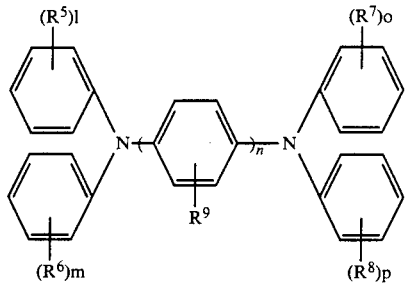

wherein $R^5$, $R^6$, $R^7$, $R^8$ and $R^9$ are the same or different, hydrogen atom, lower alkyl group, lower alkoxy group or halogen atom, n is an integer from 1 to 3, l, m, o and p are the same or different, integers from 0 to 2, and at least one selected from the group consisting of following groups:

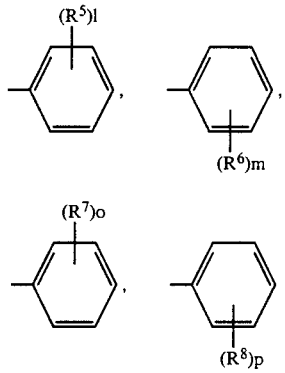

may form a condensed ring with benzene ring which may have lower alkyl group, lower alkoxy group or halogen atom as a substituent;

(III)

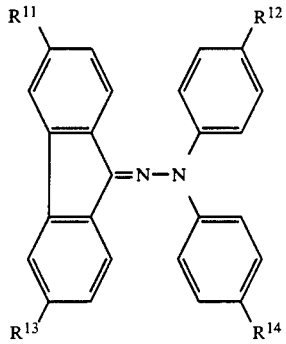

wherein $R^{11}$, $R^{12}$, $R^{13}$ and $R^{14}$ are the same or different, hydrogen atom or alkyl group.

24. The electrophotosensitive material according to claim 1, wherein said charge-generating material is in the range of 3 to 15 parts by weight and said charge-transferring material is in the range of 50 to 100 parts by weight to 100 parts by weight of said binding resin.

* * * * *